US006536349B2

(12) United States Patent
Patterson et al.

(10) Patent No.: US 6,536,349 B2
(45) Date of Patent: Mar. 25, 2003

(54) EXPLOSIVE SYSTEM FOR CASING DAMAGE REPAIR

(75) Inventors: Michael L. Patterson, Alvarado, TX (US); Richard J. Foret, Lafayette, LA (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 09/817,369

(22) Filed: Mar. 21, 2001

(65) Prior Publication Data

US 2002/0134270 A1 Sep. 26, 2002

(51) Int. Cl.[7] ..... F42B 3/087
(52) U.S. Cl. ..... 102/323; 102/312; 102/313
(58) Field of Search ..... 102/323, 312, 102/313

(56) References Cited

U.S. PATENT DOCUMENTS 3,718,512 A * 2/1973 Hurst ..... 149/2
3,731,625 A * 5/1973 Slawinski ..... 102/24 R
3,810,425 A * 5/1974 Post ..... 102/23
4,006,687 A * 2/1977 Ridgeway ..... 102/28 R
4,160,413 A * 7/1979 Ridgeway ..... 102/24 HC
5,789,697 A * 8/1998 Engelke et al. ..... 102/202.5
5,907,132 A * 5/1999 Hardage ..... 102/306
6,408,761 B1 * 6/2002 Arai et al. ..... 102/302

OTHER PUBLICATIONS

JRC brochure "JRC Wellhead Severing Service", dated Oct., 1999.
JRC brochure "JRC Steel Cutting Systems" dated Oct., 1999.
JRC brochure "JRC Junk Shot Service" dated, Oct., 1999.
JRC brochure "Quick Dredge Service", dated Oct., 1999.

* cited by examiner

*Primary Examiner*—Peter A. Nelson
(74) *Attorney, Agent, or Firm*—Marlin R. Smith; J. Richard Konneker

(57) ABSTRACT

An explosive system is disclosed which may be used in repair of damaged casing. In a described embodiment, an explosive system includes a flexible elongated tubular container with a liquid explosive disposed within the container. As an alternative, the liquid explosive may be flowed into a wellbore without being retained within a container. The liquid explosive is detonated in the wellbore, thereby fragmenting the damaged casing and forcing it out into a formation surrounding the wellbore.

19 Claims, 4 Drawing Sheets

EXPLOSIVE SYSTEM FOR CASING DAMAGE REPAIR

BACKGROUND

The present invention relates generally to operations performed in conjunction with a subterranean well and, in an embodiment described herein, more particularly provides an explosive system for casing damage repair.

Casing damage presents several distinct problems. This is particularly so where the casing has been damaged in such a way that access therethrough is limited. In these situations, access through the damaged casing must typically be restored before remedial measures, such as installation of a casing patch or an expandable casing liner, may be taken.

Unfortunately, methods of restoring access through damaged casing have proven inadequate in many circumstances, such as when the casing has become "doglegged" or longitudinally compressed due to subsidence. Thus, it may be seen that it would be advantageous to provide systems and methods for repairing damaged casing which include the capability of restoring access through the damaged casing. Of course, these systems and methods would prove beneficial in other operations, as well.

SUMMARY

In carrying out the principles of the present invention, in accordance with an embodiment thereof, an explosive system and associated method are provided which solve the above problems in the art in a convenient and efficient manner which produces superior results.

In one aspect of the invention, an explosive system is provided which includes a liquid explosive disposed within a flexible elongated tubular container. The flexible container and the liquid nature of the explosive permit the explosive system to be conveniently positioned within damaged casing which might be otherwise inaccessible to rigid explosive assemblies.

The explosive system may include any of a variety of features including a specially configured upper housing for filling the container with the liquid explosive, a specially configured lower plug for retaining the liquid explosive in the container, weight material in the plug for situations in which the explosive system would otherwise be buoyant in fluid present in the wellbore, a specially configured fluid retainer which permits venting of the liquid explosive from the container, etc.

In addition, the explosive system may be conveyed into the wellbore using any of a variety of conveyances, such as a tubing or drill string, a wireline, a slickline, etc. Furthermore, the liquid explosive may be detonated using any of a variety of detonating means, such as a firing head attached to a tubing string, a detonator electrically connected to a line extending to a remote location, etc.

In another aspect of the present invention, a method is provided for repairing damaged casing in a wellbore. The method includes the steps of conveying a liquid explosive into the wellbore, positioning the liquid explosive within the damaged casing and detonating the liquid explosive. The liquid explosive may be conveyed into the wellbore using a container, such as the flexible tubular container discussed above, or the liquid explosive may be flowed into the wellbore, for example, through a tubing string.

These and other features, advantages, benefits and objects of the present invention will become apparent to one of ordinary skill in the art upon careful consideration of the detailed description of representative embodiments of the invention hereinbelow and the accompanying drawings.

DETAILED DESCRIPTION

Figure 1:
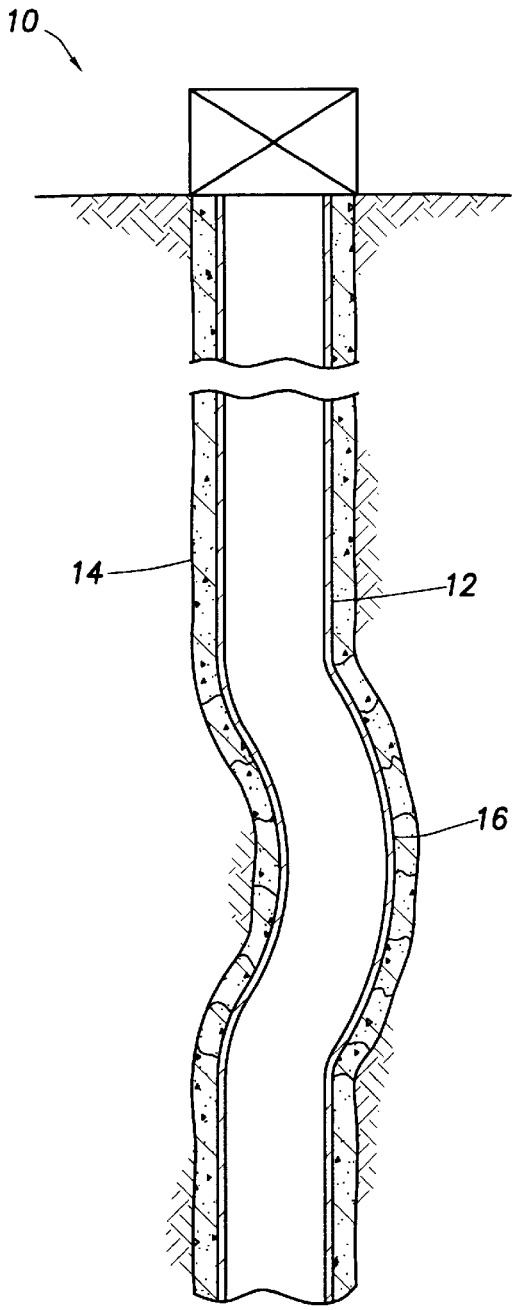
FIG. 1 is a schematic cross-sectional view of a wellbore having damaged casing therein.

Representatively illustrated in FIG. 1 is a method 10 which embodies principles of the present invention. In the following description of the method 10 and other apparatus and methods described herein, directional terms, such as "above", "below", "upper", "lower", etc., are used only for convenience in referring to the accompanying drawings. Additionally, it is to be understood that the various embodiments of the present invention described herein may be utilized in various orientations, such as inclined, inverted, horizontal, vertical, etc., and in various configurations, without departing from the principles of the present invention.

In a beginning stage of the method 10 as depicted in FIG. 1, a casing 12 cemented in a wellbore 14 has become damaged. As representatively illustrated in FIG. 1, a damaged portion 16 of the casing 12 has become "doglegged", that is, it has taken on a curvature, for example, due to subsidence resulting from production of fluid from the well. However, it is to be clearly understood that repair of this doglegged casing portion 16 in the method lo is described herein as only an example of the wide variety of uses of the principles of the present invention. Other types of casing damage may be repaired, other operations may be performed, and other uses may be made of the systems and methods described herein, without departing from the principles of the invention.

Figure 2:
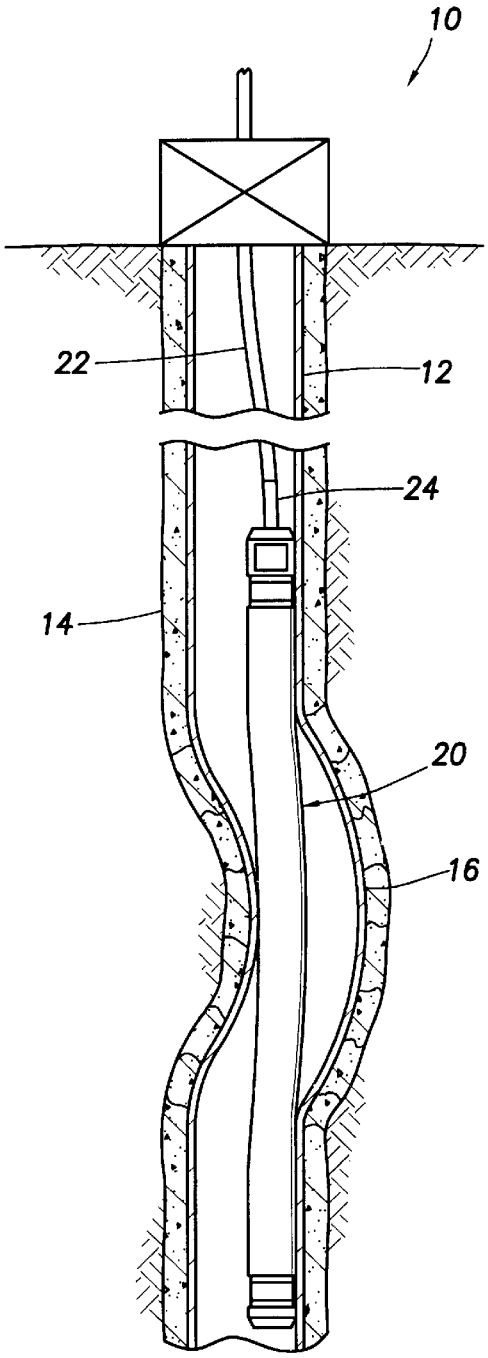
FIG. 2 is a schematic cross-sectional view of a first method and explosive system for repairing the damaged casing, the method and explosive system embodying principles of the present invention.

Referring additionally now to FIG. 2, the method 10 is representatively illustrated wherein an explosive system 20 has been conveyed into the wellbore 14 and positioned within the damaged portion 16 of the casing 12. Note that the explosive system 20 is flexible, so that it can conform to the curvature of the doglegged casing portion 16, and can extend therethrough. Preferably, the explosive system 20 also extends somewhat to either side of the damaged casing portion 16. A rigid explosive system could not conveniently extend through the doglegged casing portion 16, and conventional mills and reamers typically used to enlarge an opening through damaged casing would be sidetracked by the doglegged casing portion, instead of cutting directly to the other side of the damaged casing.

As depicted in FIG. 2, the explosive system 20 is conveyed into the wellbore 14 suspended from a coiled tubing string 22. However, any other type of conveyance could be used in place of the coiled tubing string 22. For example, another type of tubular string, such as a production tubing string or a drill string, could be used. As another example, a line, such as a wireline, electric line or slickline extending to a remote location, such as the earth's surface, could be used.

The coiled tubing string 22 includes a conventional firing head 24 for detonating an explosive in the explosive system 20. The firing head 24 may be any type of firing head, such as pressure-activated, impact-activated, electrically-activated, etc. For example, a firing head of the type used in perforating operations may be used for the firing head 24. If a line is used as the conveyance, the explosive system 20 may include an electrically initiated detonator which may be initiated via electricity conducted through the line from the remote location, or the electricity may be supplied from a firing head conveyed on the line, etc. In short, any means of detonating the explosive system 20 may be used, without departing from the principles of the invention.

Figure 3:
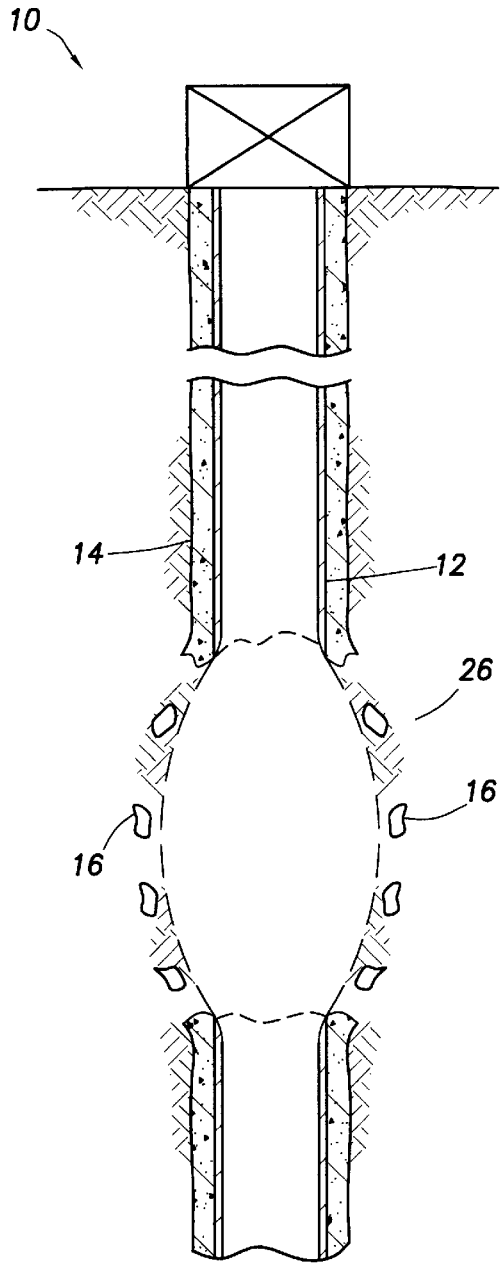
FIG. 3 is a schematic cross-sectional view of the wellbore after a liquid explosive has been detonated in the first method.

Referring additionally now to FIG. 3, the method 10 is representatively illustrated wherein the explosive system 20 has been detonated. In one important aspect of the method 10, the damaged casing portion 16 has been fragmented by the explosive system 20 detonation, and has been forced outwardly into a formation 26 surrounding the wellbore 14. Thus, the damaged casing portion 16 has not merely been cut by the explosive system 20, but has been broken up into separate fragments, and no part of the damaged casing portion 16 remains obstructing access through the casing 12.

Where the explosive system 20 is conveyed via a tubular string, such as the coiled tubing string 22, the tubular string may be used to verify access through the casing 12 after the explosive system has been detonated. This is accomplished, for example, by lowering the tubular string through the damaged casing portion 16 after the explosive system 20 has been detonated. The tubular string may include equipment, such as a conventional gauge ring, for performing this function.

Figure 4:
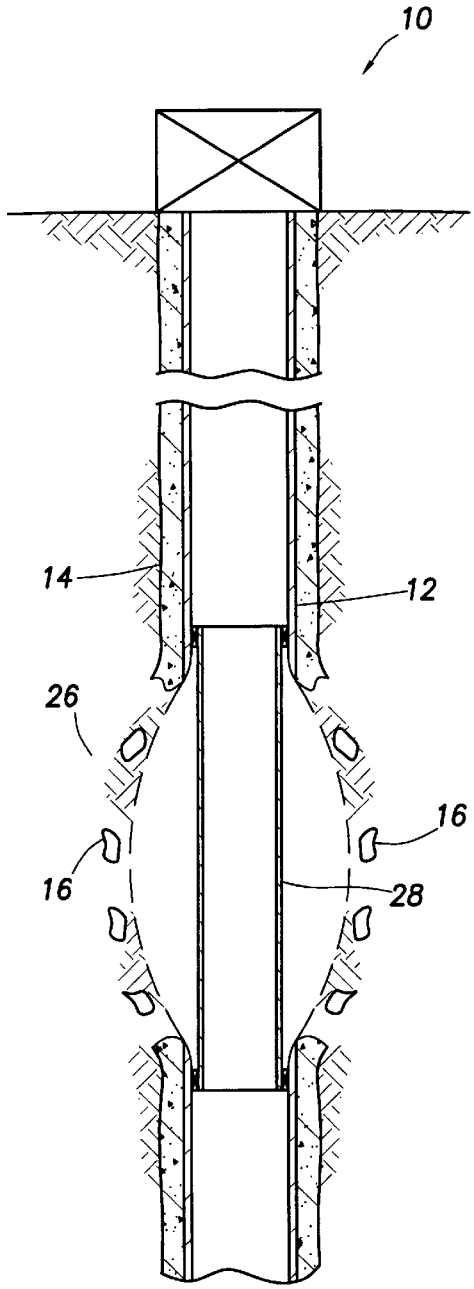
FIG. 4 is a schematic cross-sectional view of the repaired casing.

Referring additionally now to FIG. 4, the method 10 is representatively illustrated wherein a casing patch or expandable casing liner 28 has been installed, thereby completing the repair of the casing 12. Various methods are available for performing this function, and any may be used in keeping with the principles of the present invention. Note that access through the casing 12 has been restored and normal production operations at the well may now resume.

Figure 5:
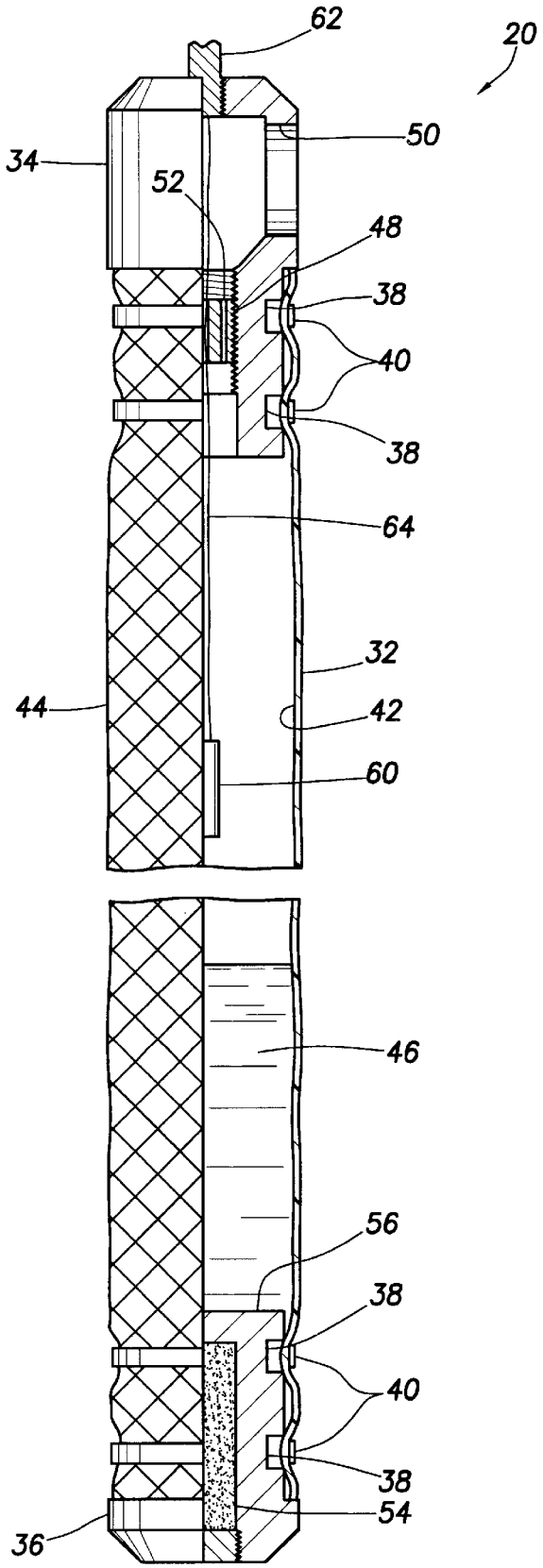
FIG. 5 is an enlarged partially cross-sectional schematic view of the explosive system used in the first method.

Referring additionally now to FIG. 5, an enlarged partially cross-sectional view of the explosive system 20 used in the method 10 is representatively illustrated. Of course, the explosive system 20 may be used in other methods, without departing from the principles of the invention.

The explosive system 20 includes a flexible elongated tubular container 32, a filler housing 34 attached to an upper end of the container and a plug 36 attached to a lower end of the container. Note that the filler housing 34 and the plug 36 have external annular grooves 38 formed thereon. Band clamps 40 bias the container 32 ends toward the grooves 38, and when the clamps are fully tightened, the container ends preferably extend into the grooves, thereby forming a seal and secure attachment between the container and each of the filler housing 34 and plug 36.

The container 32 as depicted in FIG. 5 includes an inner impermeable layer 42 and an outer protective layer 44. The inner layer 42 functions to prevent leakage of a liquid explosive 46 therethrough. Thus, it is not necessary that the inner layer 42 be impermeable to all fluids, only that it substantially prevent leakage of the explosive 46. The outer layer 44 functions to prevent damage to the inner layer 42. Thus, the outer layer 44 may be abrasion resistant, puncture resistant, etc.

In the embodiment of the explosive system 20 depicted in FIG. 5, the inner layer 42 is made of a rubber material and the outer layer 44 is made of a braided and/or woven nylon material. However, it is to be clearly understood that other materials may be used, other layers may be used, and the container 32 may be otherwise constructed, without departing from the principles of the invention.

The liquid explosive 46 enhances the ability of the explosive system 20 to pass through damaged casing, since it can change shape as needed. Preferably, the liquid explosive 46 is nitro methane which, although not formally classified as an explosive, may be made to explode in appropriate conditions.

In FIG. 5, the container 32 is shown as being only partially filled with the liquid explosive 46. In a preferred sequence of steps in the method 10, the container 32 is partially filled with the liquid explosive 46 prior to its being inserted into the wellbore 14. This provides some weight in the lower end of the container 32, which aids in extending the container while it is being lowered into the wellbore 14.

The liquid explosive 46 is poured into the container 32 via an opening 50 formed in the filler housing 34. Other means of introducing the liquid explosive 46 into the container 32 could be used in keeping with the principles of the invention.

After the explosive system 20 has been lowered partially into the wellbore 14, the container 32 is filled completely with the liquid explosive 46 via the opening 50. A fluid retainer 48 is then installed in the filler housing 34 to substantially retain the liquid explosive 46 in the container 32. However, the fluid retainer 48 preferably permits venting of the liquid explosive 46 from the container 32, for example, to prevent an undesirable pressure buildup within the container.

The fluid retainer 48 depicted in FIG. 5 is threaded into the filler housing 34 and includes a weep hole 52 for venting the liquid explosive 46. Preferably, when the fluid retainer 48 is installed, it is threaded into the filler housing 34 until some of the liquid explosive 46 is forced out of the weep hole 52, which verifies that the container 32 is completely filled with the liquid explosive. Note that other types of fluid retainers may be used, such as a rubber stopper, and other types of venting means may be used, such as a pressure relief valve, without departing from the principles of the invention.

The plug 36 may include a weight material 54 disposed within a housing 56. The weight material 54 could be, for example, lead or another very dense material, which would have a density greater than that of the housing 56.

Use of the weight material 54 in the plug 36 is not necessary, but it may be beneficial where the liquid explosive 46 has a density less than that of fluid present in the wellbore 14 when the explosive system 20 is conveyed into the wellbore. Without the weight material 54, the explosive system 20 could be buoyant in the fluid present in the wellbore 14. Thus, the weight material 54 aids in elongating the container 32 in the wellbore 14, and facilitates passage of the explosive system 20 through the damaged casing portion 16.

Preferably, the housing 56 separates the weight material 54 from contact with the liquid explosive 46. However, this feature is not necessary where there is no danger of an adverse reaction between the liquid explosive 46 and the weight material 54.

An electrically initiated detonating device 60 is depicted in FIG. 5 disposed within the container 32. In FIG. 5 the explosive system 20 is illustrated in a configuration in which it is conveyed into the wellbore 14 suspended from a line, such as a wireline, slickline, etc. Thus, a conventional rope socket 62 is shown attached to the filler housing 34, and wires 64 are shown extending from the rope socket to the detonating device 60. As described above, however, it is to be clearly understood that other means of detonating the liquid explosive 46 may be used, without departing from the principles of the invention.

Note that the wires 64 extend through the fluid retainer 48. Although this is not necessary in keeping with the principles of the invention, the same hole 52 which serves to vent the liquid explosive 46 from the container 32 may also serve to permit passage of the wires 64 through the fluid retainer 48.

The detonating device 60 is preferably positioned in the container 32 approximately midway between its upper and lower ends. In this manner, the detonating device 60 is definitely submerged in the liquid explosive 46 when the container 32 is filled with the liquid explosive, even if a small quantity of the liquid explosive has displaced through the weep hole 52. In addition, if a small quantity of the fluid present in the wellbore 14 has displaced into the container 32 through the weep hole 52, thereby contaminating a portion of the liquid explosive 46, the detonating device 60 will nevertheless likely be disposed within an uncontaminated portion of the liquid explosive, since it is positioned a substantial portion of the length of the container 32 away from its upper end.

Figure 6:
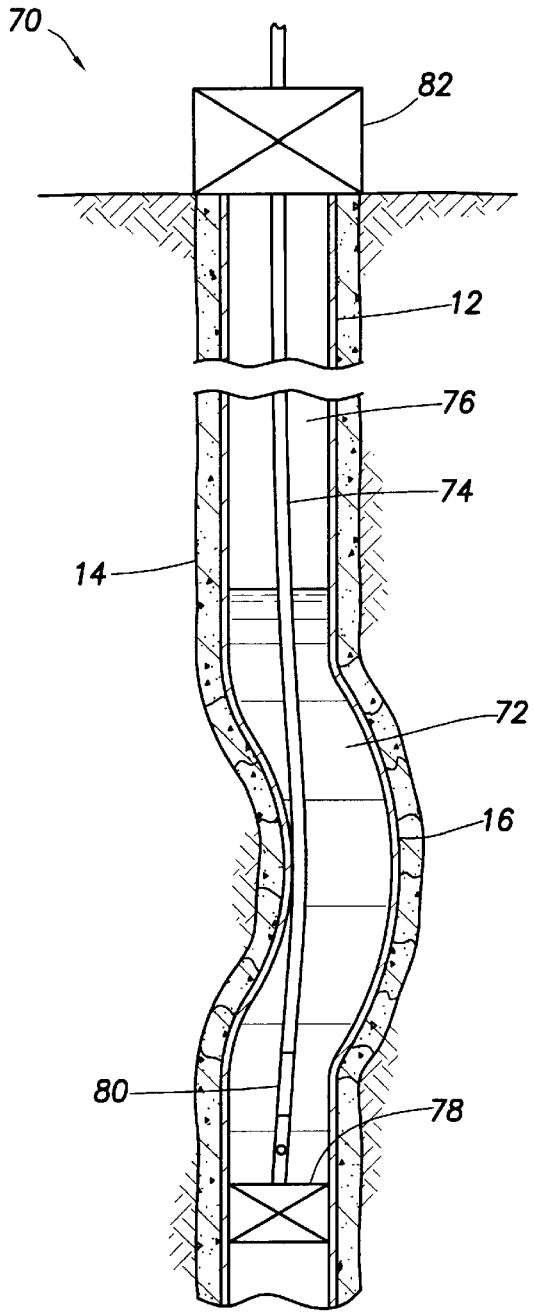
FIG. 6 is a schematic cross-sectional view of a second method of repairing the damaged casing, the second method embodying principles of the present invention.

Referring additionally now to FIG. 6, another method 70 embodying principles of the present invention is representatively illustrated. The method 70 is similar in some respects to the method 10 described above, in that a liquid explosive 72 is used in repair of the damaged casing portion 16. However, in the method 70, the liquid explosive 72 is not disposed within a flexible container when it is detonated in the wellbore 14.

Instead, the liquid explosive 72 is flowed into the damaged casing portion 16, so that it is in direct contact with the casing 12. In the embodiment of the method 70 depicted in FIG. 6, the liquid explosive 72 is flowed into the wellbore 14 by means of a coiled tubing string 74. Any other means of flowing the liquid explosive 72 into the damaged casing portion 16 may be used, without departing from the principles of the invention.

Where the liquid explosive 72 has a density greater than that of the fluid 76 in the wellbore 14, a plugging device 78, such as a bridge plug or a temporary expendable plug (for example, the Mirage Plug® marketed by Halliburton Energy Services, Inc.), may be used to support the liquid explosive below the damaged casing portion 16. The plug 78 may be conveyed into the wellbore 14 attached to the tubing string 74, or it may be otherwise conveyed into the wellbore, for example, by wireline, etc.

If the liquid explosive 72 has a density less than that of the well fluid 76, then the plugging device 78 may be set above the damaged casing portion 16. The liquid explosive 72 would then be flowed through the plugging device 78 into the damaged casing portion 16. In that case, the plugging device 78 may be a packer, and the packer would prevent the liquid explosive 72 from displacing upward out of the damaged casing portion 16.

A firing head 80 conveyed into the wellbore 14 with the tubing string 74 may be used to detonate the liquid explosive 72. Where the liquid explosive 72 has a density greater than that of the well fluid 76, preferably the firing head 80 is positioned in a lower portion of the liquid explosive, to reduce the possibility of it being disposed in a contaminated portion of the liquid explosive. However, any positioning of the firing head 8o may be used, and any type of firing head may be used, in keeping with the principles of the present invention.

Note that additional packers or other equipment may be used to prevent or minimize contamination of the liquid explosive 72. For example, a packer could be used in the tubing string 74 above the liquid explosive 72, if desired, to separate the liquid explosive from the well fluid 76.

As the liquid explosive 72 is flowed into the wellbore 14, a corresponding amount of the well fluid 76 is displaced out of the wellbore. Where the liquid explosive 72 has a density greater than that of the well fluid 76 as depicted in FIG. 6, the well fluid may displace out of a wellhead 82 as the liquid explosive 72 is flowed into the wellbore 14. However, other means of displacing the well fluid 76 out of the wellbore 14 may be used. For example, the well fluid 76 could displace into a formation intersected by the wellbore 14, etc.

Figure 7:
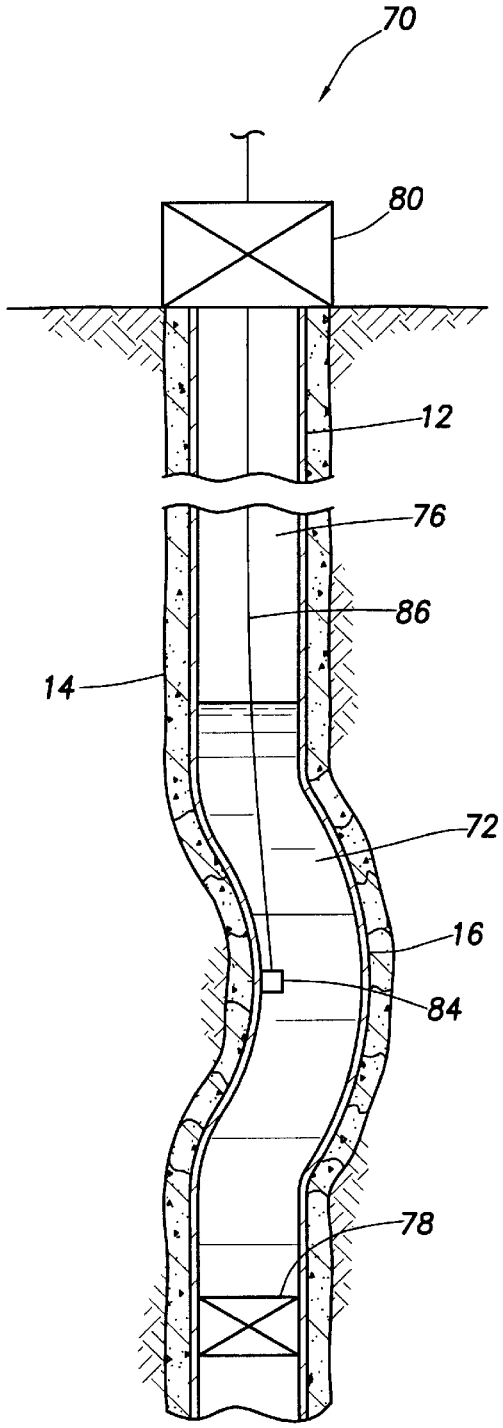
FIG. 7 is a schematic cross-sectional view of an alternate detonating step of the second method.

Referring additionally now to FIG. 7, an alternate method of detonating the liquid explosive 72 in the method 70 is representatively illustrated. Instead of using a tubing conveyed firing head, a detonating device 84 is conveyed into the liquid explosive 72 in the damaged casing portion 16 using a line 86, such as a wireline, slickline, electric line, etc.

The detonating device 84 may be electrically initiated using electricity conducted through the line 86. However, any other means of initiating the detonating device 84 may be used in keeping with the principles of the invention.

Preferably, the detonating device 84 is positioned in an uncontaminated portion of the liquid explosive 72 when it is detonated. As depicted in FIG. 7, the detonating device 84 is positioned approximately midway between upper and lower extents of the liquid explosive 72, but it could be otherwise positioned without departing from the principles of the invention.

When the liquid explosive 72 is detonated in the method 70, whether the method is performed as depicted in FIG. 6 or as depicted in FIG. 7, the damaged casing portion 16 is fragmented and forced out into the formation 26 as shown in FIG. 3. Further repair operations may then be performed as shown in FIG. 4.

Of course, a person skilled in the art would, upon a careful consideration of the above description of representative embodiments of the invention, readily appreciate that many modifications, additions, substitutions, deletions, and other changes may be made to these specific embodiments, and such changes are contemplated by the principles of the present invention. Accordingly, the foregoing detailed description is to be clearly understood as being given by way of illustration and example only, the spirit and scope of the present invention being limited solely by the appended claims.

What is claimed is:

1. An explosive system, comprising:

a flexible elongated tubular container; and a liquid explosive disposed within the container, the container, and the liquid explosive disposed therein, being positioned in a damaged portion of a subterranean well casing string, the damaged portion restricting access through the casing string.

2. The explosive system according to claim 1, further comprising a plug inserted at least partially into a lower end of the container, the plug preventing loss of the liquid explosive from the container lower end.

3. The explosive system according to claim 2, wherein the plug includes at least one external groove, and further comprising a clamp biasing the container lower end toward the groove.

4. The explosive system according to claim 2, wherein the plug includes a housing and a weight material, the weight material having a density greater than that of the housing.

5. The explosive system according to claim 4, wherein the housing separates the liquid explosive from contact with the weight material.

6. The explosive system according to claim 1, wherein the liquid explosive comprises nitro methane.

7. The explosive system according to claim 1, further comprising a housing attached to an upper end of the container, the housing permitting the liquid explosive to be poured therethrough into the container.

8. The explosive system according to claim 7, further comprising a fluid retainer disposed in the housing, the retainer substantially retaining the liquid explosive in the container, but permitting venting of the liquid explosive from the container.

9. The explosive system according to claim 7, wherein the housing includes at least one external groove, and further comprising a clamp biasing the container upper end toward the groove.

10. The explosive system according to claim 1, wherein the container includes an impermeable layer for preventing passage of the liquid explosive therethrough, and a damage resistant layer for preventing damage to the impermeable layer, the damage resistant layer being outwardly disposed relative to the impermeable layer.

11. The explosive system according to claim 10, wherein the impermeable layer is formed of a rubber material.

12. The explosive system according to claim 10, wherein the damage resistant layer is formed of a selected one of a woven and a braided material.

13. The explosive system according to claim 10, wherein the damage resistant layer is formed of a nylon material.

14. The explosive system according to claim 1, further comprising a tubular string attached to the container.

15. The explosive system according to claim 1, further comprising a detonating device disposed in the liquid explosive within the container.

16. The explosive system according to claim 15, wherein the detonating device is positioned approximately midway between opposite ends of the container.

17. The explosive system according to claim 15, wherein the detonating device is positioned a substantial portion of a length of the container away from an upper end of the container.

18. The explosive system according to claim 15, wherein the detonating device is electrically initiated.

19. The explosive system according to claim 18, wherein the detonating device is electrically initiated via a line extending to a remote location.

* * * * *